United States Patent [19]

Bierman

[11] 4,113,294

[45] Sep. 12, 1978

[54] ANTI-THEFT CLIP

[76] Inventor: Francis Andrew Bierman, 1102 Magnolia Ave., Croydon, Pa. 19020

[21] Appl. No.: 806,374

[22] Filed: Jun. 14, 1977

[51] Int. Cl.[2] ..... E05C 13/00

[52] U.S. Cl. ..... 292/346

[58] Field of Search ..... 292/346, 1; 70/416, 70/418, 417 X, 370

[56] References Cited

U.S. PATENT DOCUMENTS

| | | | |
|---|---|---|---|
| 973,001 | 10/1910 | Churchhill | 292/346 |
| 1,919,739 | 7/1933 | Minzenmayer | 292/346 |
| 2,482,340 | 9/1949 | Holmsten | 292/346 |
| 2,798,753 | 7/1957 | Wade | 292/346 |
| 2,948,141 | 8/1960 | Vahlstrom | 70/370 |
| 3,290,081 | 12/1966 | Sushan | 292/346 |
| 3,334,501 | 8/1967 | Greenwall | 70/419 |
| 3,718,014 | 2/1973 | Delgadillo | 70/417 |
| 3,740,980 | 6/1973 | Schimizzi et al. | 70/417 |

FOREIGN PATENT DOCUMENTS

| | | | |
|---|---|---|---|
| 2,507,049 | 4/1975 | Fed. Rep. of Germany | 70/417 |

*Primary Examiner*—Richard E. Moore
*Attorney, Agent, or Firm*—Robert J. Mooney

[57] ABSTRACT

An anti-theft clip for securing a conventional lock cylinder to a car door and for preventing unwanted tampering with a lever operatively connected to the lock cylinder. The clip includes resilient legs which straddle and hold the lock cylinder. Panels attached to the resilient legs shield the lock cylinder from unwanted tampering.

3 Claims, 6 Drawing Figures

ANTI-THEFT CLIP

BACKGROUND OF THE INVENTION

This invention relates to means for securing car door locks to the car doors and in particular to such means which not only secure the locks but also prevent tampering with the locks.

Many car door locks when used in conjunction with certain door handle assemblies, can be manipulated from a door-locked position to a door-unlocked position. This unwanted tampering can be accomplished by inserting a tool through holes which accommodate the exterior portions of the door handle assembly. After insertion, the tool is manipulated to move a lever operating arm attached to the car door lock cylinder.

Accordingly it is an object of this invention to provide an anti-tampering or anti-theft clip which not only mounts a car door lock cylinder to a car door but also prevents unwanted tampering with a lever or arm operatively connected to the door lock cylinder. These and other objects of the invention are achieved as follows:

SUMMARY OF THE INVENTION

An anti-theft clip is provided with two resilient legs which span and hold a conventional lock cylinder. Two panels are attached to the resilient legs. The panels shield the lock cylinder from tampering. The panels are of sufficient size to also prevent tampering with an operating arm or lever operatively attached to the lock cylinder.

Other objects, advantages and novel features of the invention will become apparent from the following detailed description of the invention when considered in conjunction with the accompanying drawings.

DESCRIPTION OF THE PREFERRED EMBODIMENT

Figure 1B:
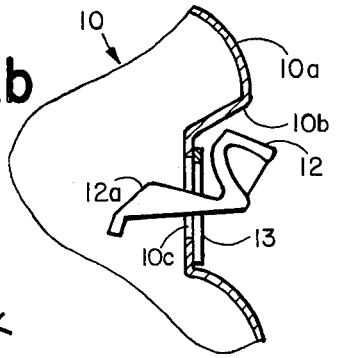
FIG. 1B is a partial sectional view of a portion of the door shown in FIG. 1A and illustrates a thematic representation of a conventional door handle assembly.
Figure 1A:
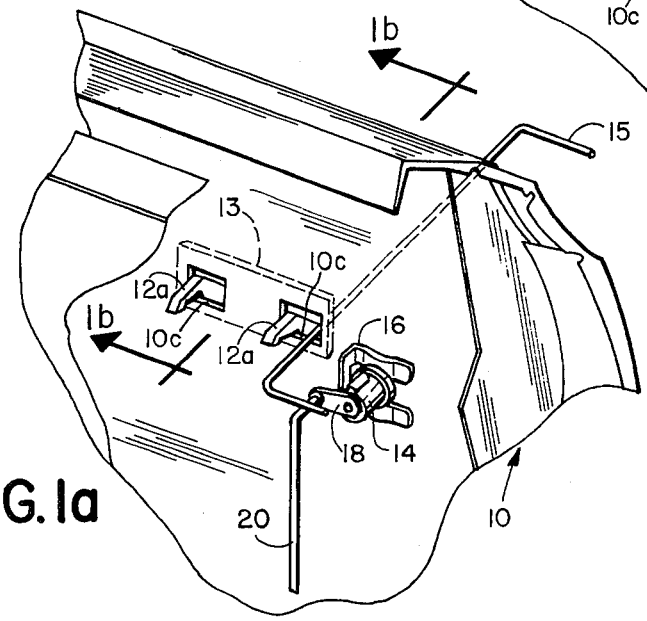
FIG. 1A is a partially fragmented isometric view of a conventional car door which illustrates those portions of the interior of the door germane to this invention.

FIG. 1A is a partially fragmented isometric view of a conventional car door 10 which illustrates the interior door structure germane to this invention. FIG. 1B is a partial sectional view along the lines **1*b*—1*b* shown in FIG. 1A; it illustrates the exterior surface 10*a* of the car door 10 and a thematic representation of a conventional door handle assembly 12**.

The door handle assembly 12 forms no part of this invention. As shown in FIG. 1B, the door handle assembly 12 typically reposes within a recess **10*b* provided in the exterior surface 10*a* of the car door 10. The door handle assembly 12 is conventionally pivotally mounted to the door 10 in a manner not shown. The door 10 is provided with an opening 10*c* which accommodates the lever operating portions 12*a* of the door handle assembly 12. As is well known the lever operating portions 12*a* control levers (not shown) which operate a door latch mechanism (not shown). The door handle assembly 12 is spaced from the exterior surface of the recess 10*b* with an open slotted plastic insert 13 secured within the recess 10*b***.

When the door handle assembly is in the UP position, as shown in FIG. 1B, the interior of the door is accessible through the opening **10*c***.

With further reference to FIG. 1A, a conventional lock cylinder 14 is secured to the interior of the door 10 with a conventional U-shaped clip 16 such as that disclosed in the U.S. Pat. No. 2,948,141. The end of the cylinder 14 is provided with a movable arm 18 which is attached to a link 20. The other end of the link 20 operatively engages a door latch mechanism (not shown) to lock or unlock the door latch (not shown) upon movement of the link 20.

In FIG. 1A, the arm 18 is shown in the door — locked position. Upon insertion of a key into the lock cylinder, the arm 18 moves downwardly in a counter — clockwise direction to thereby move the link 20 which unlocks the door latch mechanism (not shown).

At this point it should be noted that a suitably sized and shaped tool 15 could be inserted from the exterior side of the car door 10 and through the opening **10*c* in the door recess 10*b* to thereby engage the arm 18, or elbowed portion, if any, of the link 20, and move it from its horizontally oriented door-locked position to its vertically oriented door-unlocked position. As will be explained hereinafter this unwanted entry and unlocking without benefit of a key is prevented by providing a cylinder clip 22 which not only secures the cylinder 14 to the door 10 but also shields the arm 18** from unwanted tampering.

Figure 2A:
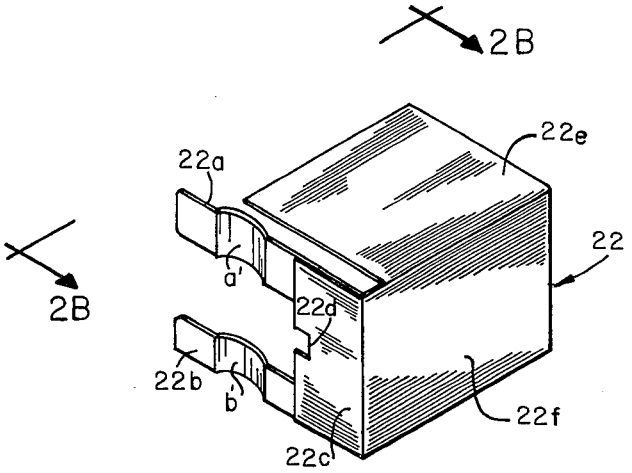
FIGS. 2A, 2B & 2C are illustrations of the anti-theft clip of this invention.

The anti-tampering clip 22 of the present invention is shown in an isometric view in FIG. 2A. The clip 22 is preferably formed from spring steel or other suitable material.

The clip 22 includes two spaced resilient legs 22A, 22B which extend from a transverse connecting or span portion **22*c*. As best seen in FIG. 2C, the span portion 22*c* is provided with a cutout 22*d* which accommodates a correspondingly shaped lug 14*a* protruding from the lock cylinder 14. The lug 14*a* nests within the cutout 22*d* to thereby prevent rotation of the clip 22. (The lock cylinder 14 is registered with the door 10** to prevent rotation in a conventional manner, not shown).

With further reference to FIG. 2A, the clip 22 also includes a rectangularly shaped top panel **22*e* and a similarly shaped side panel 22*f*. The top panel 22*e* is spaced from the leg 22*a*. The span portion 22*c* and the legs 22*a*, 22*b* are preferably formed as a unit. The top panel 22*e* and side panel 22*f* may also be formed at the same time as the span portion 22*c* and the legs 22*a*, 22*b*** or may be added thereto in a subsequent manufacturing operation in any conventional manner.

Figure 2B:
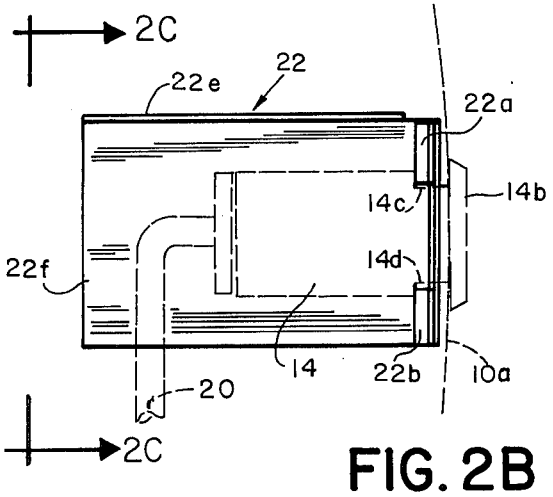
Figure 2C:
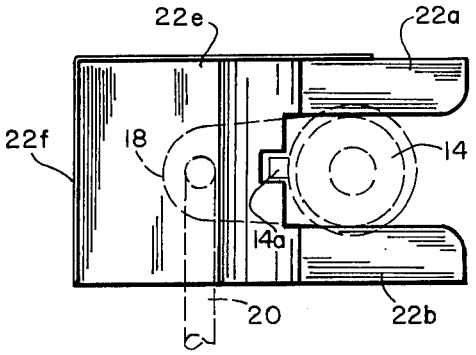

As best seen in FIGS. 2A and 2B, the legs **22*a*, 22*b*** are bowed at *a'* and *b'* respectively, intermediate their ends. The bowing increases resiliency and imparts a spring like action to the legs, **22*a*, 22*b*, to firmly secure the cylinder 14 to the door 10. As best seen in FIG. 2B, the cylinder 14 is provided with a key flange 14*b* and two slots 14*c*, 14*d*. As is well known the legs 22*a*, 22*b* repose within the slots 14*c*, 14*d*, respectively; the cylinder 14 is then securely mounted to and through the door by the tendency of the spring like legs 22*a*, 22*b* to urge the flange 14*b* tightly against the exterior surface of the car door 10**.

Figure 3:
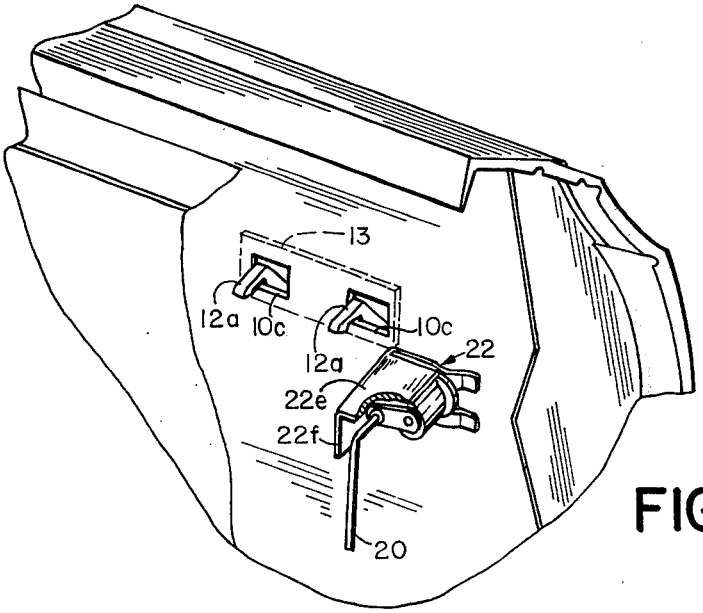
FIG. 3 is a view similar to FIG. 1A showing the anti-theft clip of this invention in place.

In FIG. 3 the anti-theft clip 22 of the present invention is shown in place. With the clip 22 oriented as there shown, the side panel 22*f* and the top panel 22*e* effectively prevent tampering with the arm 18 by the insertion of a tool through the opening 10*c*.

Comparison of FIGS. 1 and 3 clearly shows that the present invention provides a safe and inexpensive anti-theft device for those cars provided with the system shown in FIG. 1.

Although the invention has been explained and illustrated in a car door environment, the invention has universal application and may be used in any environment where unwanted tampering with a lock is to be minimized or eliminated.

I claim:

1. A resilient retaining clip for securing a lock cylinder to another member, said clip including a transverse connecting portion having spaced parallel legs extending therefrom a first panel extending from said transverse connecting portion and a second panel extending from said first panel wherein said spaced parallel legs are each bowed intermediate their respective ends.

2. A retaining clip according to claim 1 wherein one edge of said transverse connecting portion is provided with a cutout.

3. A retaining clip according to claim 1 wherein said first panel extends perpendicularly from said transverse connecting portion and said second panel extends from said first panel in a direction parallel to said legs.

* * * * *